United States Patent [19]

Warren

[11] 4,006,592

[45] Feb. 8, 1977

[54] VALVE ARRANGEMENTS FOR RECIPROCATING PISTON MACHINES

[76] Inventor: Glenn B. Warren, 1361 Myron St., Schenectady, N.Y. 12309

[22] Filed: Nov. 17, 1975

[21] Appl. No.: 632,313

[52] U.S. Cl. ..... 60/39.63; 123/41.77; 123/41.85; 123/188 A

[51] Int. Cl.[2] ..... F02G 3/02

[58] Field of Search ..... 60/39.6, 39.61, 39.62, 60/39.63; 123/90.24, 41.17, 41.85, 41.77, 188 GC, 188 A, 188 AF

[56] References Cited

UNITED STATES PATENTS

| | | | |
|---|---|---|---|
| 2,459,447 | 1/1949 | Milliken | 60/39.63 |
| 2,997,759 | 4/1961 | Milliken | 60/39.63 |
| 3,088,276 | 5/1963 | Hudson | 60/39.6 |
| 3,577,729 | 5/1971 | Warren | 60/39.63 |
| 3,826,081 | 7/1974 | Van Avermaete | 60/39.63 |
| 3,877,220 | 4/1975 | Girodin | 60/39.63 |

*Primary Examiner*—Clarence R. Gordon
*Attorney, Agent, or Firm*—Joseph V. Claeys

[57] ABSTRACT

A valve arrangement for controlling the flow of fluid from an inlet passage to the cylinder of a reciprocating piston compressor wherein the valve is actuated to the open position by the pressure of the fluid compressed in the cylinder by planned early closing of the discharge valve as the piston approaches its top dead center position; actuation of the inlet valve to the closed position being effected at the desired time by operation of a cam and valve closing spring.

8 Claims, 1 Drawing Figure

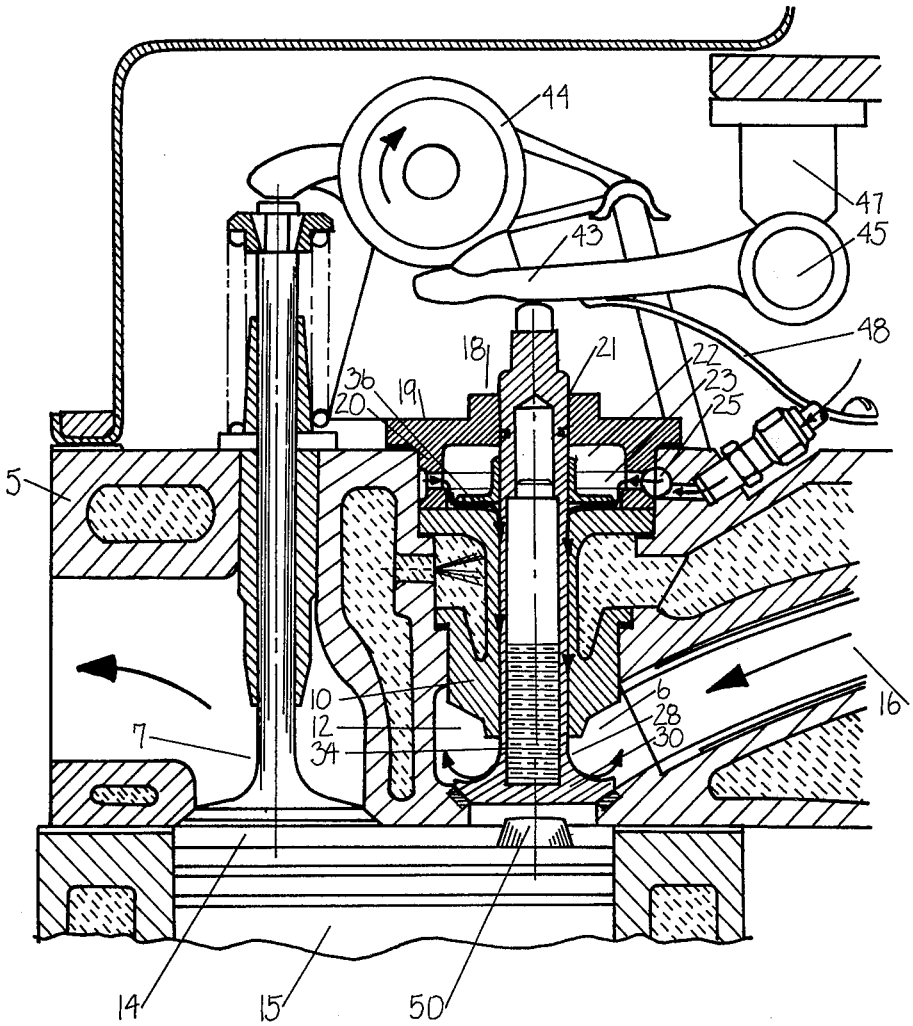
44
47
45
43
48
18
21
22
23
25
36
20
19
5
10
12
34
6
28
30
16
7
14
15
50

VALVE ARRANGEMENTS FOR RECIPROCATING PISTON MACHINES

BACKGROUND OF THE INVENTION

This invention relates to valve arrangements for controlling the flow of fluids and more particularly to a pneumatically opened-cam closed arrangement, particularly suited for controlling the flow of high temperature fluids of reciprocating piston engines and which obviate the need for mechanical springs.

While this invention has a wide range of applications, it is especially useful in controlling the flow of high temperature fluids in reciprocating engines employing external combustion systems of the type disclosed in Warren's U.S. Pat. No. 3,577,729; consequently, it will be described in detail in that connection.

Air pollution has become a major problem in the United States and other highly industrialized countries of the world. There is ample evidence that major contributors to this pollution are automobiles employing the conventional internal combustion, reciprocating piston engines.

The new and improved engine of Warren's U.S. Pat. No. 3,577,729, while retaining many of the basic structural features of the conventional mass produced, internal combustion engine, provides greater fuel economy and exhibits substantially lower level of basic pollutants (CO, HC, $NO_x$) because it employs a stable, controlled, external combustion system. The analysis and calculations show that the most restrictive federal emission requirements are fully met even by a high performance new engine and even in a vehicle weighing up to 5000 pounds.

The use of an external combustion system subjects at least some of the valve means to operating conditions different from those of the conventional engine so that some of such conventional valve arrangements may not be entirely satisfactory for use with an engine such as that described in Warren's U.S. Pat. No. 3,577,729. For example, the typical cam-spring type valve arrangement may not be entirely satisfactory for controlling the flow of the high temperature combustion products from the external combustion system into the engine cylinders for expansion therein to drive the pistons in well known manner.

The prior art valve arrangements of the conventional internal combustion engines are typically of the type which are opened by a cam against the resistance of a valve closing spring. In order to achieve the required rapid closing of the inlet valve to control the flow of the high temperature gas from the external combustion system engine of the type shown in Warren's U.S. Pat. No. 3,577,729, to the expansion cylinder it may be necessary to use a custom made, exceedingly strong, valve spring. The use of such a strong valve spring is undesirable not only because the spring itself is more costly, but also because it results in high inertias and in great stress on the entire valve train. The combination of these factors results in increased valve cost, as well as overall increased costs and complexity of the engine.

It is an object of this invention, therefore, to provide a valve arrangement for controlling the flow of high temperature fluids which overcomes one or more of the foregoing described difficulties.

It is another object of the invention to provide a valve arrangement for controlling the flow of fluids which is simple, reliable and low in cost.

It is still another object of the invention to provide a fast acting, low cost, reliable valve arrangement for controlling the flow of fluids which obviates the need for valve spring.

It is a further object of the invention to provide a fast acting valve arrangement for an engine which is simple, reliable and of low cost and allows for simplification of the engine design and consequent reduction in engine production costs.

It is a still further object of the invention to provide a fast acting valve arrangement for controlling the flow of fluids which includes means to dampen or cushion the force of impact as the valve is closed.

SUMMARY OF THE INVENTION

Briefly stated, in accordance with one aspect of the invention, there is provided a pneumatically opened-cam closed valve arrangement for controlling the flow of fluid from an inlet passage to an engine working cylinder having a piston reciprocally positioned therein. A valve having a head and a stem extending therefrom is actuated to its open position by the pressure of the fluid compressed in the cylinder by planned early closing of the discharge valve as the piston approaches top dead center position. The speed and amount of the pressure actuated opening of the valve is controlled by the position and shape of the crankshaft driven cam and associated valve actuating linkage. Actuation of the valve to the closed position is effected at the required time by further action of the cam.

BRIEF DESCRIPTION OF THE DRAWING

The sole FIGURE shows an elevational sectional view of the valve arrangement which is opened pneumatically and closed by means of a cam; only the parts of the engine which are pertinent in describing the working of the valve are illustrated.

DETAILED DESCRIPTION

The sole FIGURE of the drawing illustrates one embodiment of the invention incorporated in an external combustor, reciprocating piston engine of the type described in Warren U.S. Pat. No. 3,577,729. The valve arrangement of the invention is employed to control the flow of the high temperature fluid from the combustor to the expansion cylinder of a reciprocating piston engine. An important feature of the valve arrangement of the present invention is that movement of the valve head to open the inlet passage is away from the engine piston, whereas in the usual internal combustion engine arrangements the valve head moves toward the piston. This is important since in an engine such as that described in Warren U.S. Pat. No. 3,577,729, the cylinder head to piston clearance remains small for reasons of efficiency so that failure in the cam closing of the discharge valve or opening of the inlet valve could result in very high pressure above the piston with possible resulting engine damage. Such a condition is not possible with the valve arrangement of this invention since any such pressure build-up tends to open the valve.

As illustrated in the drawing, an engine cylinder head 5 is provided with suitable inlet and discharge valve arrangements, shown generally by reference numerals 6 and 7 respectively, for controlling the flow of fluid into and out of the expansion cylinder of a reciprocating piston engine. The inlet valve arrangement 6 is constructed in accordance with the present invention.

Discharge valve arrangement 7 may be of any suitable type and is illustrated as being of the type which is opened by a cam against the resistance of a valve closing spring.

As shown in the drawing the inlet valve arrangement of this invention includes a valve guide 10 extending into an inlet passage 12 which in turn communicates at one end with the expansion cylinder 14 having a piston 15 reciprocally disposed therein. The other end of inlet passage 12 communicates with the manifold 16 of the external combustor system (not shown).

A housing 18 having a top 19 and a skirt 20 surrounds the outer end of the valve guide 10 and is adapted to be suitably secured to cylinder head 5. A central bore 21 is provided in top 19. Skirt 20 defines an enclosed annular cavity 22 above the outer end of valve guide 10. Annular cavity 22 is provided with an annular channel 23 which communicates with a port 25 through the skirt 20 of housing 18; port 25 being adapted to be connected to a suitable source of compressed air, such as the compression means which supplies compressed air to the inlet end of the external combustion system.

A valve 28 has a head 30 arranged to mate with a valve seat 32 of inlet passage 12. Extending from the head 30 is a valve stem 34 which passes through valve guide 10 and through the central bore 21 in the top 19 of housing 18. Valve stem 34 has secured thereto an annular plate member 36 the diameter of which is slightly smaller than that of annular cavity 22 so that it defines a small annular passage 38. Plate member 36 also defines a small space between it and the outer end of the valve guide 10. Suitable seal rings 39 are also carried by the valve stem 34 at the region thereof which is disposed in the top 19 of housing 18.

In accordance with this invention, means are provided to actuate valve 28 between its open and closed positions to control the flow of fluid through inlet passage 12 in a simple and reliable manner and in accordance with the operating requirements of the engine. The valve is closed by the cam follower 43 riding on the high side of cam 44, mounted on the pivot 45 which is secured to a member inside the housing 47. Cam 44 is preferably driven at crankshaft speed. A spring 48 biases the cam follower 43 against the cam 44 and prevents chatter. At the predetermined time the cam follower moves to the low side of cam 44 allowing the valve 28 to be moved to the open position by the force exerted on the valve head 30 by the compressed fluid in cylinder 14 as the piston approaches it top dead center position; the discharge valve having been closed at a proper previous time. The geometry of the cam surface is also effective in controlling the rate of opening of the valve. To assure opening of the valve 28 under all conditions, such as for example very low pressure, a projection 50 may be provided on the top of piston 15 which would contact valve head 30 at the top dead center piston position urging the valve open.

The operation of the valve is best explained by following in sequence the operational steps beginning at the time when the valve 28 is in the closed position; the head 30 rests against valve seat 32 closing the inlet passage 12. The piston 15 moves upward in the expansion cylinder 14 compressing the gases above it. As piston 15 approaches the top dead center position (the discharge valve will have been closed previously), the gases being compressed above the piston exert an increasing pressure on the bottom surface of the valve head 30. At this same time cam follower 43 then moves to the low side of cam 44 and allows the valve stem 34 to be pushed upward to the open position. If the valve stem 34 sticks, the projection 50 on the top of the piston located directly underneath of the valve head 30 urges it upward. Since the piston 15 at the moment of impact immediately before it reverses its motion is traveling extremely slowly, the impact causes a negligible amount of noise and wear. Furthermore, such impact occurs only under most extreme operating conditions, such as, for example, low pressure. Just as soon as valve head 30 moves away from seat 32 the pressure in the spaces above and below the valve quickly equalize. Thus, it is only the unbalanced pressure acting on the bottom of the stem area which acts to accelerate the valve upward. The cross section area of stem 34 must be made large enough to provide for the proper upward acceleration of the valve for the design speed of the engine.

To assist in cooling the valve, cool compressed air from a source such as the compression cylinder (not shown) is forced through port 25 and annular channel 23 into the annular cavity 22. From there the air is directed downward between the valve guide 10 and the valve stem 34. The cool compressed air is at a higher pressure than that of the combustion gases; consequently, it not only cools the valve as it flows downward along the stem 34 but it also keeps the hot combustion gases away from the head 30 and prevents their entry into space between the valve stem 34 and the valve guide 10. If necessary, for extremely high temperature applications valve 28 may be of the cooled type wherein a quantity of, a suitable material, such as Sodium, is contained in a hollow valve stem.

The valve guide 10 is also cooled by circulating cooling fluid in the coolant passages and forcing it under pressure through small apertures in the jacket wall 70 into the region adjacent the outside of the valve guide 10. The resulting turbulance provides for a better heat transfer between the valve guide 10 and the cooling fluid.

Another advantage of the valve arrangement of this invention is that its extremely low weight and hence low inertia, together with the simplicity of it actuating mechanism may permit a so-called "push-rod" operation from a common lower positioned cam shaft disposed in the "center of the V" on a V-engine rather than the more costly overhead cam-shaft illustrated.

While only a preferred embodiment of the invention has been shown and described by way of illustration, many modifications and changes will occur to those skilled in the art. It is, therefore, to be understood that the appended claims are intended to cover all such modifications and changes as fall within the true spirit and scope of the invention.

What is claimed as new and desired to be secured by Letters Patent of the United States is:

1. In a reciprocating piston machine wherein inlet and discharge valve means control the flow of fluid into and out of a working cylinder of said machine in a desired timed sequence, the combination with said machine of an improved inlet valve arrangement comprising:

a. an inlet valve having a head and a stem extending therefrom;

b. a housing defining an enclosed cavity adjacent said cylinder and surrounding said valve stem;

c. an annular plate carried by said valve stem within said enclosed cavity and near the bottom thereof, said annular plate having a diameter smaller than the inside diameter of said cavity and defining a metering passage therewith and a space between said annular plate and the bottom of said cavity;

d. means for actuating said inlet valve to its open position in a direction away from said cylinder, said means including pressure producing means comprising said working piston as it approaches its top dead center position in conjunction with preselected early closing of said discharge valve means so that the pressure produced above said piston and applied to the head and stem of said valve is operative to actuate said valve to the open position; and e. control means operatively associated with said inlet valve for actuating said inlet valve to its closed position, said control means comprising a rotary cam means driven in timed relationship with said machine and a pivotally mounted rocker arm means operatively associated with said cam means.

2. The improved inlet valve arrangement of claim 1 wherein said pivotally mounted rocker arm means has one end thereof coupled with the end of said valve stem remote from said head and the other end thereof arranged and adapted to be moved by means operatively associated with said cam means.

3. The improved inlet valve arrangement of claim 1 wherein said pivotally mounted rocker arm means has one end thereof coupled with the end of said valve stem remote from said head and the other end thereof arranged and adapted to ride on the surface of said cam means.

4. The improved inlet valve arrangement recited in claim 1 including means for supplying fluid under pressure to said enclosed cavity which fluid flows along said valve stem and prevents the fluid being supplied to said cylinder from flowing upward along said valve stem and provide cooling for said valve.

5. The improved inlet valve arrangement recited in claim 1 wherein said reciprocating piston machine is an engine having an external combustion system and said inlet valve arrangement is operative to control the flow of the high temperature fluid from said external combustion system to an expansion cylinder of said engine and wherein said fluid under pressure which is supplied to said enclosed cavity is from the same source which supplies the combustion air to the external combustion system.

6. The improved valve arrangement recited in claim 5 wherein said pivotally mounted rocker arm means has one end thereof coupled with the end of said valve stem remote from said head and the other end thereof arranged and adapted to be moved by means operatively associated with said cam means.

7. The improved valve arrangement recited in claim 5 wherein said pivotally mounted rocker arm means has one end thereof coupled with the end of said valve stem remote from said head and the other end thereof arranged and adapted to ride on the surface of said cam means.

8. The improved valve arrangement recited in claim 5 including means for supplying fluid under pressure to said enclosed cavity which flows along said valve stem and prevents the high temperature fluid from said external combustion system from flowing upward along said valve stem.

* * * * *